United States Patent [19]

Wilkerson

[11] Patent Number: 4,793,098

[45] Date of Patent: Dec. 27, 1988

[54] REVERSIBLE, WIDTH ADJUSTABLE, GATE

[76] Inventor: Destre L. Wilkerson, 10601 W. State, Boise, Id. 83703

[21] Appl. No.: 66,087

[22] Filed: Jun. 24, 1987

[51] Int. Cl.[4] ..... E06B 7/00

[52] U.S. Cl. ..... 49/55; 49/381; 49/501; 52/98

[58] Field of Search ..... 49/381, 382, 388, 55, 49/501, 505; 52/98, 100; 16/252

[56] References Cited

U.S. PATENT DOCUMENTS

| | | | |
|---|---|---|---|
| 3,295,158 | 1/1967 | Hotchkiss, Jr. et al. | 16/252 |
| 4,319,431 | 3/1982 | Siers | 49/501 |
| 4,465,262 | 8/1984 | Ipre et al. | 49/55 |
| 4,610,432 | 9/1986 | Lewis et al. | 52/98 |

FOREIGN PATENT DOCUMENTS

| | | | |
|---|---|---|---|
| 0217319 | 2/1957 | Australia | 49/381 |

*Primary Examiner*—Kenneth J. Dorner

*Assistant Examiner*—Gerald Anderson

*Attorney, Agent, or Firm*—Paul F. Horton

[57] ABSTRACT

A reversible, width adjustable gate including a vertically oriented hinge tube supporting a pair of vertically spaced hinges; an end tube, parallel with and laterally spaced from the hinge tube; an upper framing tube horizontally oriented and attached to the uppermost end of the hinge tube and end tube; and a lower framing tube horizontally oriented and attached to the lowermost end of the hinge tube and end tube. Both the upper and lower framing tubes have extension portions protruding beyond the end of the end tube for attachment of a latch. The extension portions may be scored to facilitate breaking or cutting of the tubes for proper width. Reversible hinges permit and up-side-down reversal of the gate and in that both upper and lower framing tubes are provided with removable extension portions, correct width adjustment for attachment of the latch may be made by selective removal of a selected extension portion.

4 Claims, 1 Drawing Sheet

REVERSIBLE, WIDTH ADJUSTABLE, GATE

BACKGROUND OF THE INVENTION

1. Field of the Invention

This invention relates to gates, and, more particularly, to gates which are completely reversible and which may have their width shortened for installment of a latch.

2. Description of the Prior Art

It is often desirable, both for esthetic effects and for proper functioning of a gate that the gate be reversed, either end for end or side for side. Because gates are often installed to existing gate hinge posts and latch posts, it is also important that the gate be adjusted in width for proper installation, including latching to the latch post. Currently, gates are made adjustable by telescoping framework, as typified by U.S. Pat. Nos. 3,705,468 issued to J. E. Ashworth and 1,115,605 issued to W. F. Snohr. Such gates are not reversible in an up-side-down manner and are inherently wobbly because of the necessity of having telescoping parts or sections. Additionally, such gate are expensive and often are plagued by maintenance problems because of corrosion or accumulation of dirt and debris in the telescoping parts.

The present invention overcomes these difficulties by providing a gate which is fully reversible and which includes extension members which may be selectively shortened to provide a gate of desired width for proper attachment of a latch.

SUMMARY OF THE INVENTION

For making the gate completely reversible and for proper width adjustment, the present invention provides a gate which includes horizontal framework extensions at both top and bottom of the gate, which may be selectively shortened for reducing the width of the gate, while, at the same time providing a suitable latch attachment member.

It is therefore a primary object of the present invention to provide a reversible, width adjustable, gate.

More particularly, it is an object of the present invention to provide a gate which includes horizontal extensions, at both upper and lower ends of the gate, which may be shortened to adjust the width of the gate while still providing suitable member for latch attachment.

Even more particularly, it is an object of the present invention to provide such extensions which are scored for convenient, standardized, reduction of the width of a gate.

It is also an object of the present invention to provide a gate wit reversible hinges which, in combination with such horizontal extensions, permits a gate to be completely reversible and yet width adjustable.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
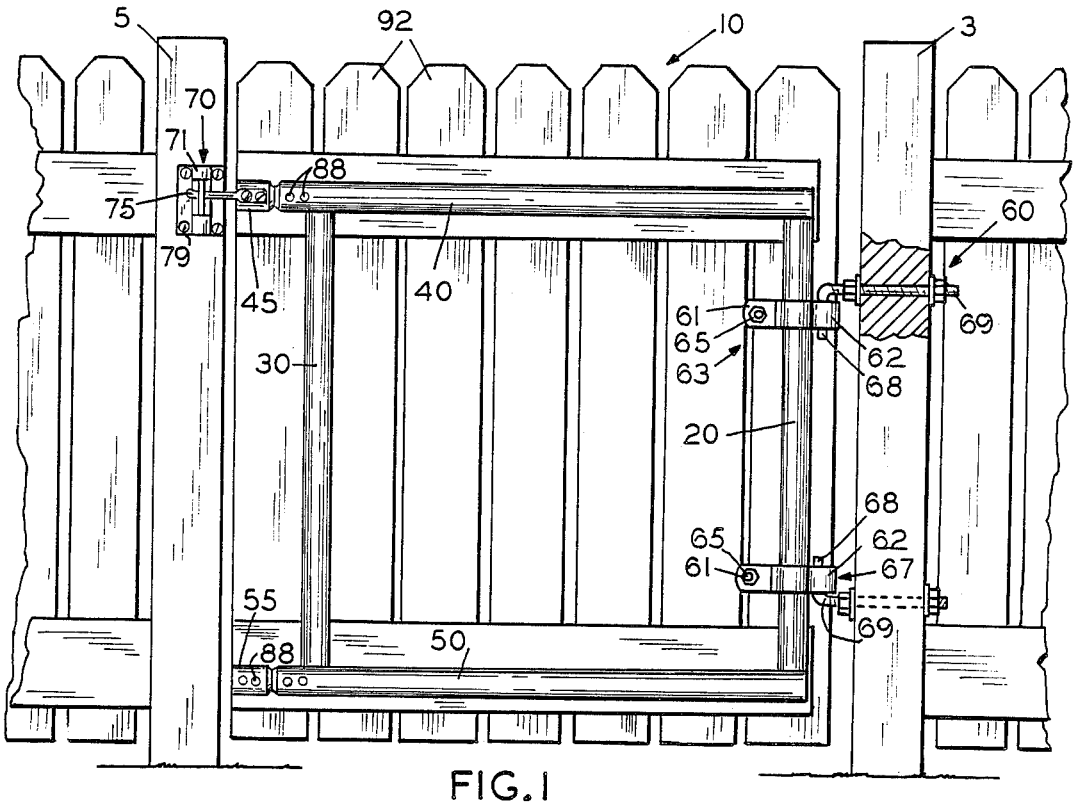
FIG. 1 is a side view of a reversible, width adjustable gate made according to the present invention, shown mounted to gate posts.

Referring now to the figures and FIG. 1 in particular, an embodiment to be preferred of a reversible, width-adjustable, gate 10 made according to the present invention is disclosed. Gate 10 includes a hinge tube 20, an end tube 30; a pair of horizontally framing tubes 40 and 50 hinge means, designated generally by the numeral 60 and latch means, designated generally by the numeral 70.

Hinge tube 20 and end tube 30, which may be constructed of any suitable material, preferably iron, are vertically oriented and laterally spaced, parallel to one another. The hinge tube is located adjacent an existing gate post 3 to which it, and hence the gate, is pivotally attached by hinge means 60. End tube 30 is located on the end of the gate, opposite the hinge tube, and adjacent latch post 5.

Extending between, made preferably of the same material, and attached to the end tube and hinge tube, by welding or otherwise, are a pair of vertically spaced framing tubes, upper tube 40 and lower tube 50. Upper tube 40 is affixed to the uppermost end of the hinge tube and end tube and lower tube 50 is affixed to the lowermost end of the hinge tube and end tube in parallel relationship. Both the upper tube and lower tube are provided with extension portions, designated generally by the numerals 45 and 55, respectively, which protrude beyond end tube 30 towards latch post 5. The extension portions are each adapted for shearing, i.e., cutting or breaking, to shorten the extension portions and hence reduce effective width of the gate. The extension portions, once they are shortened to a selected length, are used for attachment of a portion of latch 60, such as latch rod 75, seen to advantage in FIGS. 1 and 4.

It is to be noticed and appreciated that the latch portion will be attached to the uppermost extension, such as extension 45, in the figures shown, and that if the gate is reversed to and upside down position that extension 55 will serve as the attachment member and that, for this reason, both extensions are necessary for the complete operation of the present invention. Since the extensions, 45 and 55, are identical in construction, only description of one extension will suffice.

While either extension may be sheared in a conventional manner, as by a hacksaw, it is preferred that each extension member be provided with one or more scores 80, for standardized removal of one or more segments 82. The term "score" as used herein and in the appended claims refers to indentations, holes, slots, or other weakening of the extensions for convenient separation of one part of the extension from another part or from the respective upper or lower framing tube.

Used in cooperation with extensions 45 and 55 of upper tube 40 and lower tube 50, respectively, is reversible hinge means 60. In the preferred embodiment, two hinges, designated by the numerals 63 and 67, are used. Both upper hinge 63 and lower hinge 67 include a hinge clamp 61, bolted to hinge tube 20, in vertically spaced relationship one to the other, and a pivot member, J-bolt 69, which is bolted to hinge post 3, in like spaced relationship. Hinge clamps 61 are attached to hinge tube 20 by clamp bolts 65 and hence are readily rotated or removed. Each of the hinge clamps are provided with a cylindrical portion 62, having a vertical longitudinal axis, for receiving a respective pivot pin 68 of J-bolts 69. In this manner, the gate is pivotally supported by the gate post and can readily be reversed thereupon.

Figure 2:
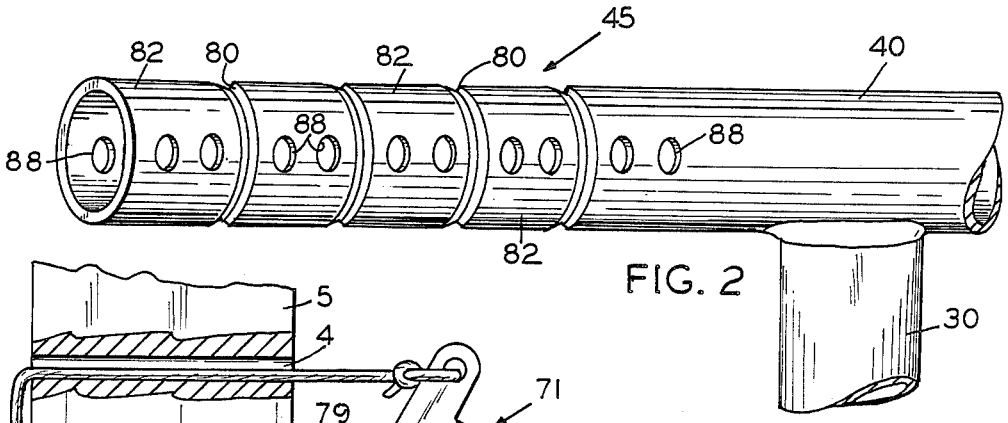
FIG. 2 is a perspective view of one of the extension members, showing scoring.
Figure 4:
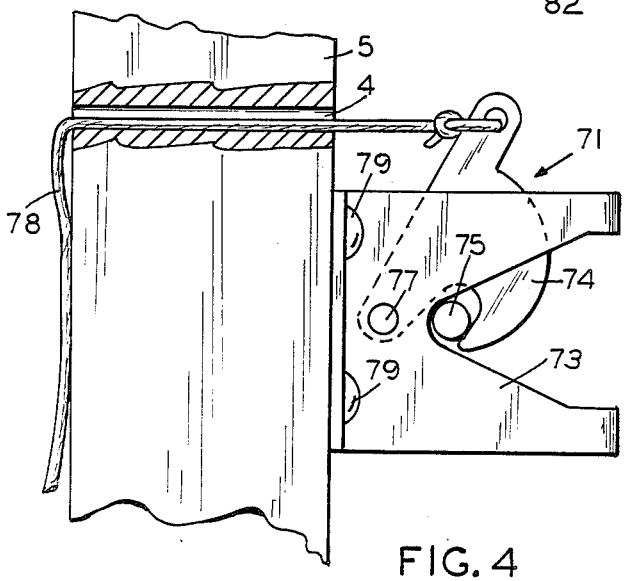
FIG. 4 is a side view of the latch of the present invention.
Figure 3:
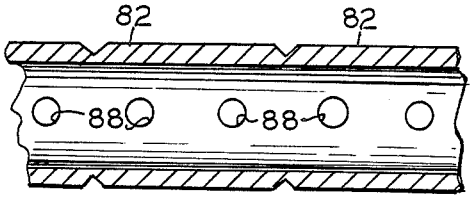
FIG. 3 is a cross-sectional view of an extension member, showing scoring.

Latch means 70, in the preferred embodiment, includes a latch bolt 75, affixed to a selected extension member 45 or 55, and a catch portion 71 which is attached to latch post 5, as seen to advantage in FIGS. 1 and 4. The latch bolt is affixed to the extension member by a pair of threaded bolts or screws 79, which are receivable within apertures 88. The apertures may be provided in segments 82 of the extension members for convenient attachment, even though other segments may be removed, as shown in FIG. 2. Referring again to FIG. 4, catch portion 71 of the latch may be provided with a bolt receiver 73 and a clasp 74 which is pivotal upon receiver 73, by means of pivot bolt 77, and operable to latch the bolt in a closed position. A cord 78, attached to clasp 74 and extending through a drilled opening 4 in post 5 permits the gate to be opened from the opposite side of the gate from the latch.

As may be seen in FIG. 1, upper and lower tubes 40 and 50 are each provided with a horizontally disposed two by four board for further attachment of vertically mounted wooden slats 92 of any desired shape as a decorative fencing material.

Having thus described in detail a preferred embodiment of the present invention, it is to be appreciated and will be apparent to those skilled in the art that other physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A reversible, width adjustable, gate comprising:

a vertically oriented hinge tube;

an end tube, parallel with and laterally spaced from said hinge tube;

a pair of vertically spaced, horizontally oriented framing tubes secured to said hinge tube and said end tube in parallel relationship, each of said framing tubes provided with an extension portion protruding beyond said end tube, and each of said extension portions provided with one or more scores for segmental removal of said extension portions; and hinge means operable to support said gate in a conventional or reversed, up-side-down, position.

2. A reversible, width adjustable, gate comprising:

a vertically oriented hinge tube;

an end tube, parallel with and laterally spaced from said hinge tube; and a pair of vertically spaced, horizontally oriented framing tubes; one of said framing tubes affixed to the uppermost terminal end of said hinge tube and said end tube and the other framing tube affixed to the lowermost terminal end of said hinge tube and end tube; each of said framing tubes having an extension portion protruding beyond said end tube, each of said extension portions of each of said framing tubes, provided with one or more scores for segmental removal of a desired length of a respective extension portion to shorten said tubes to a desired length for attachment of a latch member to a selected one of said tubes.

3. The gate as described in claim 2 further comprising reversible hinge means.

4. The gate as described in claim 2 wherein said hinge means includes a pair of hinge clamps and a pair of pivot members; said hinge clamps vertically spaced and mounted on said hinge tube, each of said clamps defining a cylinder having a vertical horizontal axis; said pivot members vertically spaced and mounted on a gate post, and each pivot member provided with a vertically extending pivot pin operable to be received within a cylinder of a respective clamp for pivotally supporting said gate in a conventional or reversed position.

* * * * *